US007762478B1

(12) United States Patent
Czimmek et al.

(10) Patent No.: US 7,762,478 B1
(45) Date of Patent: Jul. 27, 2010

(54) HIGH SPEED GASOLINE UNIT FUEL INJECTOR

(75) Inventors: Perry Robert Czimmek, Williamsburg, VA (US); Hamid Sayar, Newport News, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 560 days.

(21) Appl. No.: 11/652,754

(22) Filed: Jan. 12, 2007

Related U.S. Application Data

(60) Provisional application No. 60/759,158, filed on Jan. 13, 2006.

(51) Int. Cl.
*B05B 1/08* (2006.01)

(52) U.S. Cl. ..... 239/102.2; 239/533.2; 239/585.1; 239/533.3; 239/533.8; 239/585.5; 123/446; 123/447

(58) Field of Classification Search ..... 239/102.1, 239/102.2, 537, 540, 533.13, 533.14, 533.1, 239/533.2, 533.4, 533.8, 533.9, 585.1, 585.3, 239/900; 123/446, 447, 497, 498
See application file for complete search history.

(56) References Cited

U.S. PATENT DOCUMENTS

| | | | | | |
|---|---|---|---|---|---|
| 4,553,059 | A | | 11/1985 | Abe et al. | |
| 4,784,322 | A | | 11/1988 | Daly | |
| 4,877,187 | A | * | 10/1989 | Daly | 239/89 |
| 4,884,750 | A | * | 12/1989 | Werding | 239/337 |
| RE34,591 | E | * | 4/1994 | Yoshida et al. | 239/96 |
| 5,471,959 | A | * | 12/1995 | Sturman | 123/447 |
| 5,560,549 | A | * | 10/1996 | Ricco et al. | 239/533.8 |
| 5,709,341 | A | * | 1/1998 | Graves | 239/92 |
| 5,722,600 | A | * | 3/1998 | Horiuchi | 239/533.8 |
| 5,833,146 | A | * | 11/1998 | Hefler | 239/533.8 |
| 6,079,636 | A | * | 6/2000 | Rembold et al. | 239/88 |
| 6,161,774 | A | * | 12/2000 | Ricco | 239/127 |
| 6,347,614 | B1 | * | 2/2002 | Evers et al. | 123/446 |
| 6,360,960 | B1 | | 3/2002 | Nally, Jr. et al. | |
| 6,499,471 | B2 | * | 12/2002 | Shen et al. | 123/498 |
| 6,540,160 | B2 | * | 4/2003 | Rodriguez-Amaya et al. | 239/533.2 |
| 6,622,938 | B2 | * | 9/2003 | Fischer et al. | 239/124 |
| 6,772,965 | B2 | * | 8/2004 | Yildirim et al. | 239/533.3 |
| 6,793,158 | B2 | * | 9/2004 | Ricco | 239/533.1 |
| 6,871,800 | B2 | * | 3/2005 | Tinwell et al. | 239/533.2 |
| 6,874,705 | B2 | * | 4/2005 | Parche | 239/533.3 |
| 6,969,009 | B2 | | 11/2005 | Bachmaier et al. | |
| 7,073,730 | B2 | * | 7/2006 | Haag et al. | 239/102.2 |
| 7,077,379 | B1 | * | 7/2006 | Taylor | 251/129.06 |
| 7,175,105 | B2 | * | 2/2007 | Plecher et al. | 239/102.2 |
| 7,213,775 | B2 | * | 5/2007 | Ricco et al. | 239/533.2 |
| 2002/0008157 | A1 | * | 1/2002 | Kuzuyama | 239/88 |
| 2006/0289682 | A1 | * | 12/2006 | Kammerer et al. | 239/533.8 |

* cited by examiner

*Primary Examiner*—Len Tran
*Assistant Examiner*—Trevor E McGraw

(57) ABSTRACT

A gasoline unit injector includes a high speed, high force actuator such as a magnetrostrictive or piezoelectric actuator. The actuator operates a positive displacement diaphragm pump. The pumping volume is isolated from a supply rail by an inlet check valve, and is isolated from the engine manifold by an outlet check valve. Each of the check valves includes a disk having a central anchor and a peripheral valve seat. Diaphragm movement reduces pump volume and thereby displaces fuel at high pressure through outlet valve. Fuel spray is formed by geometry of outlet valve, the frequency of actuation, and mass and pressure of the displaced fuel. Relaxation of actuator, and therefore diaphragm, increases pump volume and thereby draws fuel into pump volume through the check valve.

8 Claims, 6 Drawing Sheets

HIGH SPEED GASOLINE UNIT FUEL INJECTOR

CROSS REFERENCE TO RELATED APPLICATIONS

This application claims the benefit of U.S. Provisional Patent Application Ser. No. 60/759,158 entitled "High Speed Gasoline Unit Fuel Injector," filed on Jan. 13, 2006, the contents of which are hereby incorporated by reference herein in their entirety.

FIELD OF THE INVENTION

The present invention relates generally to fuel injectors, and more particularly, to a gasoline unit fuel injector having an integral, electronically activated, positive displacement pump.

BACKGROUND OF THE INVENTION

Fuel injectors are commonly employed in internal combustion engines to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The precise metering and atomization of the fuel reduces combustion emissions and increases the fuel efficiency of the engine.

Pressurized fuel is typically supplied to a fuel injector through a fuel rail or tube. The fuel injector functions as a valve that meters the pressurized fuel into an intake manifold or cylinder, where it mixes with an oxidant such as air to create the combustion mixture.

An electromagnetic fuel injector typically utilizes a solenoid assembly to supply an actuating force to open and close a fuel metering valve. Typically, the fuel metering valve is a plunger style needle valve which reciprocates between a closed position, where the needle is seated in a valve seat to prevent fuel from escaping through a metering orifice into the combustion chamber, and an open position, where the needle is lifted from the valve seat, allowing fuel to discharge through the metering orifice for introduction into the combustion chamber.

It is desirable, for emissions and performance, to minimize the size of the air entrained fuel particle during the intake cycle of internal combustion engine operation. The smaller fuel particle vaporizes more quickly to evenly distribute combustible fuel molecules with the oxygen supplied in the air. Large fuel particles may not vaporize completely within the combustion cycle, leading to the carburization and incomplete combustion of the fuel, which is inherently bad for performance, and emissions.

Conventional fuel injection strategy utilizes a pressure drop across an orifice to atomize the fuel with the energy stored in the fuel rail pressure. This is a limited source of energy for atomization. One approach for enhancing atomization is the use of a small orifice. That approach leads to manufacturing difficulty and increased risk of obstruction by contamination. That strategy also requires the precise regulation of fuel rail pressure as it has a direct impact on flow rate and spray geometry exiting the orifice. For that reason, a pressure regulator and rail pressure damper are often used in the fuel supply to the injectors.

Another fuel injection strategy is the use of a high rail pressure to increase the available atomization energy. That approach adds to the expense of the entire fuel system, including rails, pump, regulator and lines, which must all be optimized for operation at the higher pressure.

Typically, a volumetric chamber or "sac volume" exists between the discharge tip of the valve needle and the metering orifice. Upon seating of the needle on the valve seat, a volume of fuel remains within the sac and tends to drain through openings in the metering orifice after the metered fuel has already been discharged through the metering orifice, typically during low manifold pressure, high injector tip temperature operating conditions. This discharge produces rich combustion which generates unwanted exhaust emissions and reduces the fuel efficiency of the engine. Some of the fuel, however, remains in the sac which vaporizes and causes rich/lean shifts and hot start issues that are undesirable.

U.S. Pat. Nos. 4,877,187 and 4,784,322 show an electromagnetically actuated moveable metal bellows in combination with a piston and check valve, for pressurizing fuel in a fuel injector. That solution is complex and expensive. A conventional piston-type pumping operation similar to a diesel unit injector has also been attempted. A conventional diesel unit injector approach to a gasoline unit injector is not practical due to the lower viscosity and lubricating properties of gasoline fuels.

U.S. Pat. No. 7,077,379 discloses a piston pump fuel injector operated by a piezoelectric device, and having ball check valves at the inlet and outlet. A separate piezoelectric device-operated injection valve is used to meter fuel from the outlet.

U.S. Pat. No. 4,553,059 discloses a piezoelectric pump fuel injector having a piston pump operated by a piezoelectric device. The piston pump includes an o-ring seal and a Bellville washer return spring. The pumping chamber includes ball check valve at the inlet and a differential pressure-type injection nozzle at the outlet.

There is therefore presently a need to provide a fuel injector and method of injecting that reduces sac volume and permits precise control of injection volume, droplet size and spray geometry. Such an injector should minimize manufacturing costs. To the inventors' knowledge, no such injector is currently available.

SUMMARY OF THE INVENTION

One embodiment of the present invention is a fuel injector for forming a metered fuel spray in a fuel injection system of an internal combustion engine. The fuel injector comprises a body having a fuel injector inlet and a fuel injector outlet and having a longitudinal axis extending through the body; a flexible pump diaphragm having a periphery and a central portion, the periphery being secured to the body, the central portion being moveable relative to the body upon flexing of the pump diaphragm, the pump diaphragm partially defining a pumping chamber connected to the fuel injector inlet and the fuel injector outlet; and a pump actuator mounted in the body and abutting the central portion of the pump diaphragm for flexing the pump diaphragm upon actuation of the pump actuator; whereby actuations of the pump actuator pump fuel from the fuel injector inlet through the pumping chamber to the fuel injector outlet.

The outlet may further include an outlet check valve located along the longitudinal axis of the body, the outlet check valve positioned in the body for discharging pressurized fuel to form the metered fuel spray. The outlet check valve may further comprise an annular outlet valve sealing surface of the body; and an outlet valve disk secured to the body proximate the annular outlet valve sealing surface, the outlet valve disk having a periphery, the outlet valve disk having a first mode wherein the periphery contacts the annular outlet valve sealing surface to prevent flow through the outlet check valve, and a second mode wherein at least a portion of the periphery is displaced from the annular outlet valve sealing surface to discharge pressurized fuel from the pumping chamber. In that case, the outlet valve disk may be a deformable disk secured to the body at a central portion of the disk, the disk deforming to displace the periphery from the annular outlet valve sealing surface when a fuel pressure gradient across the outlet check valve exceeds a predetermined value.

In a preferred embodiment, flexing of the pump diaphragm may change a volume of the pumping chamber. The actuator may be a piezoelectric actuator, or may be a magnetostrictive actuator.

The fuel injector inlet may include an inlet check valve for admitting fuel into the pumping chamber. The inlet check valve may comprise an annular inlet valve sealing surface of the body; and an inlet valve disk secured to the body proximate the annular inlet valve sealing surface, the inlet valve disk having a periphery, the inlet valve disk having a first mode wherein the periphery contacts the annular inlet valve sealing surface to prevent flow through the inlet check valve, and a second mode wherein the periphery is displaced from the annular inlet valve sealing surface to admit fuel into the pumping chamber.

The inlet valve disk may be a deformable disk secured to the body at a central portion of the disk, the inlet valve disk deforming to displace the periphery from the annular inlet valve sealing surface when a fuel pressure differential across the inlet check valve exceeds a predetermined value.

The fuel injector may further comprise an outlet check valve located along the longitudinal axis of the body, the outlet check valve connected to the pumping chamber for discharging fuel from the pumping chamber, the outlet check valve comprising an outlet valve disk having a periphery and a central hole; an annular outlet check valve sealing surface on the fuel injector body, the annular outlet check valve sealing surface facing the periphery of the outlet valve disk; an inlet check valve located along the longitudinal axis of the body, the inlet check valve connected to the positive displacement pump for admitting fuel to the pumping chamber, the inlet check valve comprising an inlet valve disk having a periphery and a central hole; an annular inlet check valve sealing surface on the fuel injector body, the annular inlet check valve sealing surface facing the periphery of the inlet valve disk; and a check valve disk retainer pin disposed in the central holes of the inlet and outlet check valve disks, the retainer pin exerting a force on the inlet valve disk biasing the periphery of the inlet valve disk against the inlet check valve sealing surface, the retainer pin further exerting a force on the outlet valve disk biasing the periphery of the outlet valve disk against the outlet check valve sealing surface.

The pump actuator may further comprise a ball contacting the central portion of the diaphragm.

Another embodiment of the invention is a fuel injector for forming a metered fuel spray in a fuel injection system of an internal combustion engine, comprising a body having a fuel injector inlet and a fuel injector outlet; a positive displacement pump in the body for pumping fuel from the inlet through a pumping chamber to the outlet; an outlet check valve located in the fuel injector outlet, the outlet check valve connected to the pumping chamber for discharging fuel from the pumping chamber, the outlet check valve comprising an outlet valve disk having a periphery and a central hole; an annular outlet check valve sealing surface on the fuel injector body, the annular outlet check valve sealing surface facing the periphery of the outlet valve disk; an inlet check valve located in the fuel injector inlet, the inlet check valve connected to the positive displacement pump for admitting fuel to the pump, the inlet check valve comprising an inlet valve disk having a periphery and a central hole; an annular inlet check valve sealing surface on the fuel injector body, the annular inlet check valve sealing surface facing the periphery of the inlet valve disk; and a check valve disk retainer pin disposed in the central holes of the inlet and outlet check valve disks, the retainer pin exerting a force on the inlet valve disk biasing the periphery of the inlet valve disk against the inlet check valve sealing surface, the retainer pin further exerting a force on the outlet valve disk biasing the periphery of the outlet valve disk against the outlet check valve sealing surface.

The outlet check valve may be positioned in the body for discharging pressurized fuel to form the metered fuel spray.

The outlet check valve may have a first mode wherein the periphery contacts the annular outlet valve sealing surface to prevent flow through the outlet check valve, and a second mode wherein at least a portion of the periphery is displaced from the annular outlet valve sealing surface to discharge pressurized fuel from the pumping chamber.

The outlet valve disk may be deformable to displace at least a portion of the periphery of the disk away from the annular outlet valve sealing surface when a fuel pressure gradient across the outlet check valve exceeds a predetermined value.

The positive displacement pump may include a pump diaphragm that flexes to change a volume of the pumping chamber. The positive displacement pump may further include a piezoelectric actuator, or a magnetostrictive actuator.

The inlet check valve may have a first mode wherein the periphery contacts the annular inlet valve sealing surface to prevent flow through the inlet check valve, and a second mode wherein at least a portion of the periphery is displaced from the annular inlet valve sealing surface to admit fuel to the pumping chamber.

Yet another embodiment of the invention is a fuel injector for forming a metered fuel spray in a fuel injection system of an internal combustion engine, comprising a body having a fuel injector inlet and a fuel injector outlet; a positive displacement pump disposed in the body for pumping fuel from the inlet through a pumping chamber to the outlet; and an outlet check valve in the outlet comprising an outlet check valve disk, deformable to open and close the outlet check valve, the outlet check valve being positioned in the body for discharging pressurized fuel to form the metered fuel spray.

The fuel injector may further comprise an inlet check valve in the inlet comprising an inlet check valve disk, deformable to open and close the inlet check valve. In that case, the injector may also include an annular outlet check valve sealing surface on the fuel injector body, the annular outlet check valve sealing surface facing a periphery of the outlet check valve disk; an annular inlet check valve sealing surface on the fuel injector body, the annular inlet check valve sealing surface facing a periphery of the inlet check valve disk; and a check valve disk retainer pin disposed in central holes of the inlet and outlet check valve disks, the retainer pin exerting a force on the inlet valve disk biasing the periphery of the inlet valve disk against the inlet check valve sealing surface, the retainer pin further exerting a force on the outlet valve disk biasing the periphery of the outlet valve disk against the outlet check valve sealing surface.

The outlet check valve may have a first mode wherein the periphery contacts the annular outlet valve sealing surface to prevent flow through the outlet check valve, and a second mode wherein at least a portion of the periphery is displaced from the annular outlet valve sealing surface to discharge fuel from the pumping chamber.

The outlet check valve disk may be deformable to displace the periphery of the disk from the annular outlet valve sealing surface when a fuel pressure gradient across the outlet check valve exceeds a predetermined value.

That embodiment may further include a pumping diaphragm defining at least a portion of the pumping chamber and being deformable to change a volume of the pumping chamber. The positive displacement pump in that embodiment may comprise a piezoelectric actuator, or a magnetostrictive actuator.

DESCRIPTION OF THE INVENTION

The fuel injector of the present invention pressurizes fuel to a high pressure for atomization, and atomizes the high pressure fuel as it passes through an outlet valve. The injector yields highly controllable atomization and spray shape. Because the fuel is pressurized in the injector, rail pressure is used only to prevent hot fuel vaporization in the rail, and need not be regulated or damped. Sac volume below the valve seat is eliminated.

Figure 1:
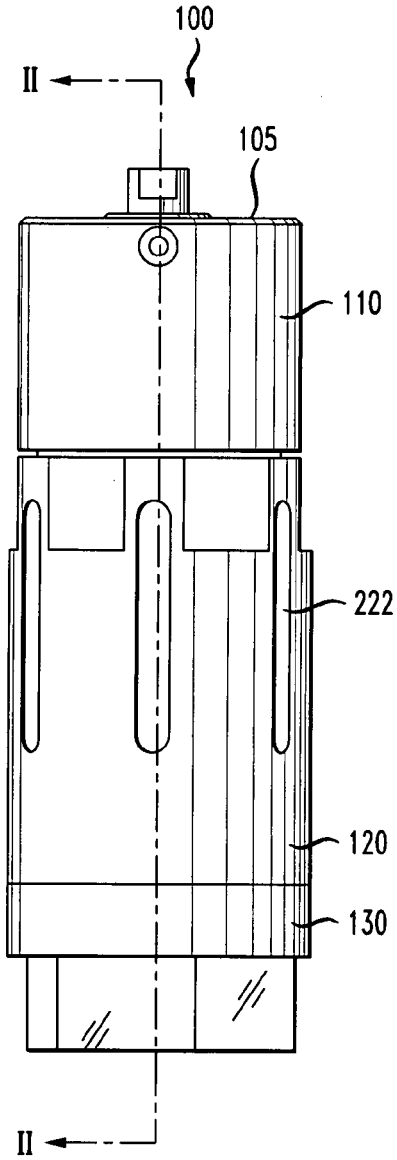
FIG. 1 is a side elevation view of a gasoline unit fuel injector in accordance with the invention.

Referring to FIG. 1, a fuel injector 100 according to the invention includes a fuel injector body 105. The body comprises a pump housing 110, a housing tube 120 and an end cap 130. The body tube may have eddy current reduction slots 222 as shown for reducing magnetic field eddy currents caused by an actuator as described below.

Figure 2:
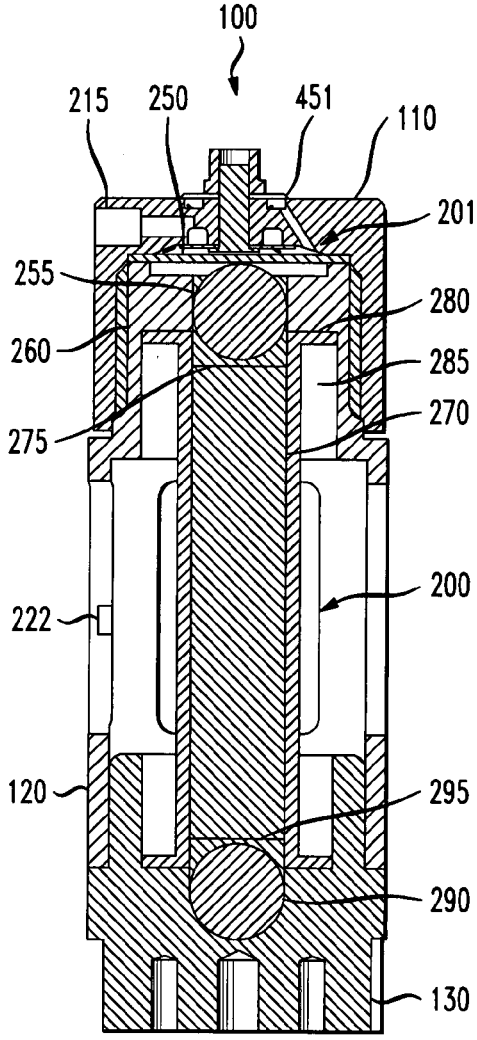
FIG. 2 is a cross sectional view of the gasoline unit fuel injector of FIG. 1, through line II-II, in accordance with the invention.

A sectional view of the fuel injector through section I-II of FIG. 1 is shown in FIG. 2. The injector 100 has a fuel injector inlet 215 and a fuel injector outlet 451. As used herein, the terms "inlet" and "outlet" refer to passages connecting a pumping volume of the fuel injector (discussed below) with the outside of the fuel injector.

The pump housing 110 and housing tube 120 may be connected using a threaded joint 260 as shown in FIG. 2. Alternatively, those elements may be connected using a press fit, a weld, an adhesive or any combination thereof. The housing tube 120 may similarly be attached to the end cap 130. In a preferred embodiment of the invention, those connections are not subjected to pressurized fuel and therefore need not be hermetic.

A high force, high speed actuator 200 is used to activate a positive displacement fuel pump 201 in the injector. The high force, high speed actuator is preferably a physical property motor such as a magnetostrictive or piezoelectric actuator. Such actuators are capable of generating highly controllable displacements with extremely small response times.

The exemplary actuator 200 shown in FIG. 2 is a magnetostrictive actuator including a magnetostrictive driver rod 270. The driver rod may be a magnetostrictive alloy such as Terfenol-D that exhibits magnetostrictive properties. Wire coil windings 285 wrapped on a bobbin 280 generate a magnetic field upon application of current to the windings through electrical leads (not shown) routed from the windings 285 through a channel in the end cap 130. The resulting magnetic field causes the magnetostrictive driver rod 270 to change in length.

The actuator 200 also includes transfer caps 275, 295, and balls 255, 290, at one or both ends of the driver rod 270. The transfer caps 275, 295 may be constructed of a ferromagnetic material and thereby complete a magnetic circuit through the magnetostrictive driver rod 270 and windings 285. The balls 255, 290 provide pivot points for force transfer from the rod 270, preventing excessive bending forces or torque from being applied to the rod 270.

In an alternative embodiment, the actuator may be a piezoelectric actuator. For example, a piezoelectric multilayer actuator (PMA) comprising a series of stacked piezoelectric disks wired in parallel may be used to provide a length change in response to an electrical signal.

Changes in length of the actuator 200 cause a pump diaphragm or pump disk 250 to flex, as described in more detail below. When the diaphragm is caused to flex, fuel is pumped by the positive displacement pump 201 from the inlet 215 to the outlet 451. In alternative embodiments, the actuator may a operate piston of a piston pump, or another type of positive displacement pump.

Figure 3:
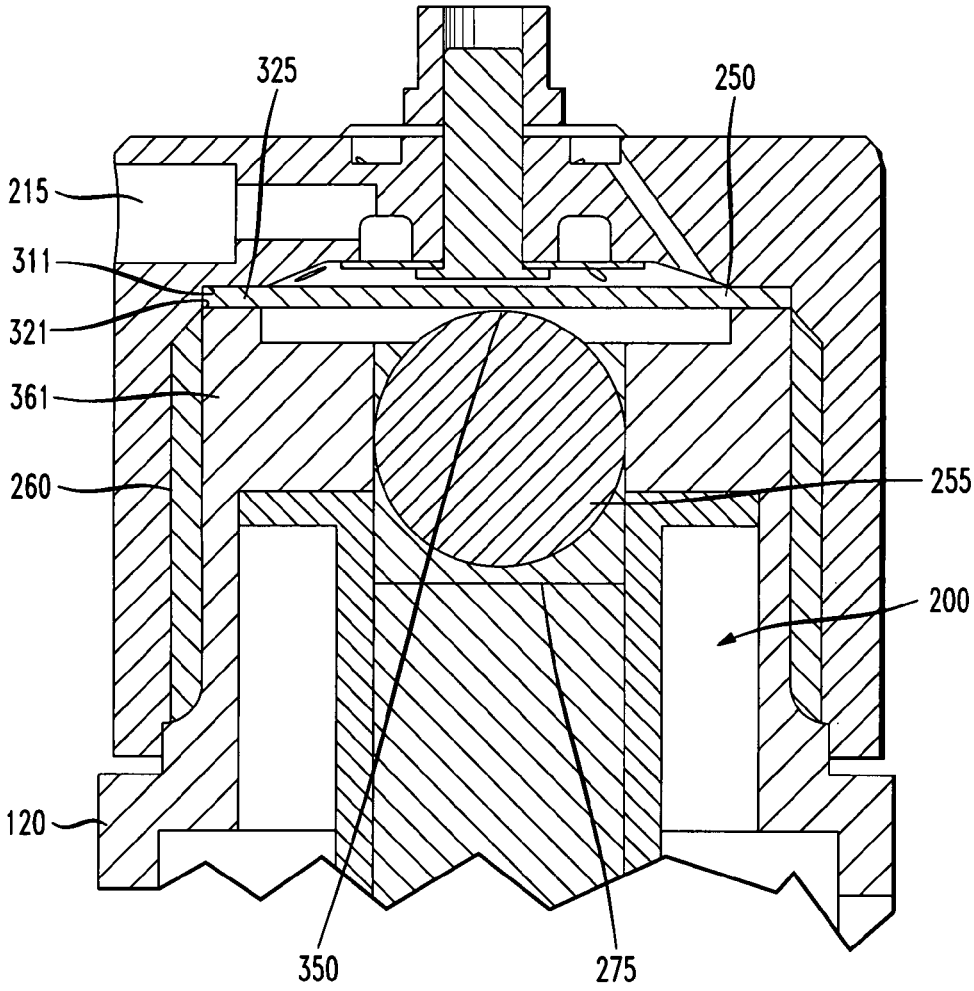
FIG. 3 is a detailed cross sectional view of the gasoline unit fuel injector of FIG. 1.

An enlarged view of the pump housing 110 and associated components is shown in FIG. 3. A reduced diameter section 361 of the body tube 120 fits inside the pump housing 110, and the two are attached with the threaded connection 260. A raised annular face 321 is formed on an end of the reduced diameter section 361 of the body tube. An annular face 311 of the pump housing 110 opposes the annular face 321. A peripheral region 325 of the pump diaphragm 250 is trapped between the faces 321, 311 when the pump housing 110 and body tube 120 are assembled. Compression of the peripheral region 325 of the diaphragm 250 between the faces 311, 321 creates a mechanically strong, hermetic seal between the pump diaphragm and each of the pump housing 110 and the body tube 120.

The diaphragm 250 may be constructed of a spring material such as spring steel to ensure extremely high fatigue durability. Fatigue life is further extended by using a small displacement per pump cycle, and using multiple pump cycles during one injection. The maximum strain on the diaphragm during a pump cycle is thereby minimized.

The actuator 200 exerts a force on the diaphragm 250 in a central region 350 of the diaphragm. In the preferred embodiment shown, the force is exerted at a contact point in the central region 350 that is a tangent point where the ball 255 contacts the diaphragm 250. The ball may be constructed of a non-ferrous material such as ceramic to direct magnetic flux through the transfer cap 275 and body tube 120, and to minimize wear. One skilled in the art will recognize that other contact arrangements are possible, and should be designed to minimize wear and localized stress in the diaphragm while optimizing the magnetic circuit.

Figure 4:
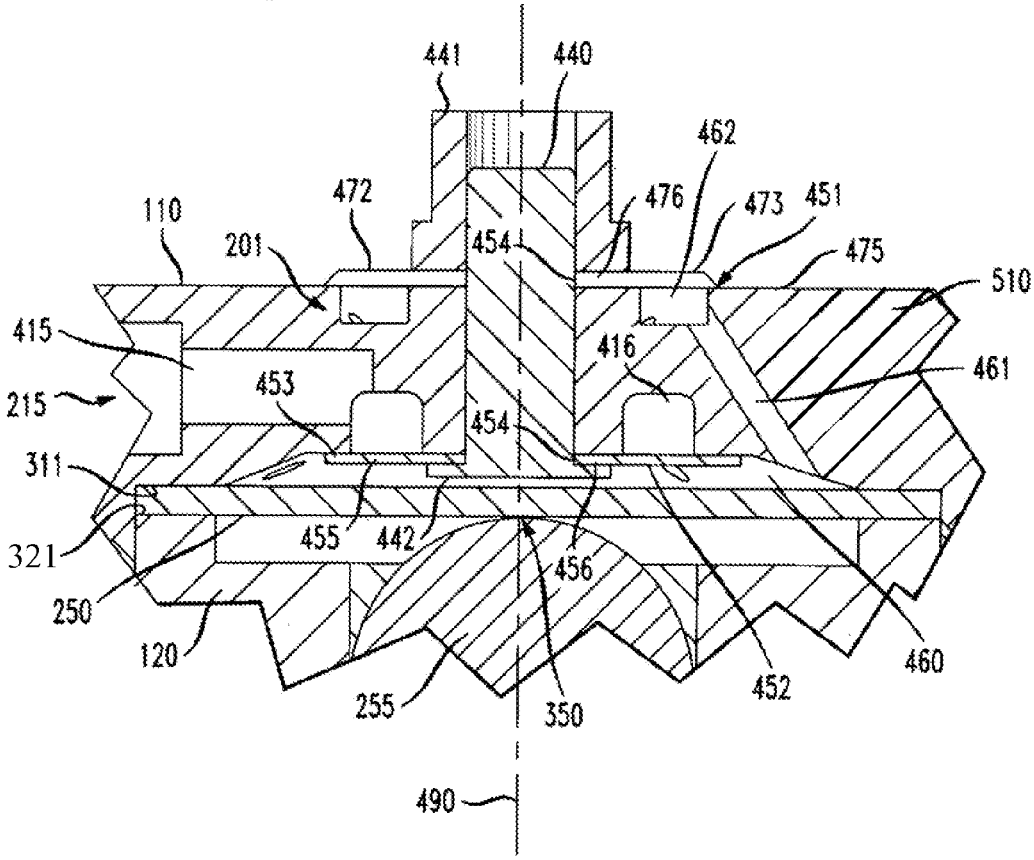
FIG. 4 is a further detailed cross sectional view of the gasoline unit fuel injector of FIG. 1.

An enlarged cross sectional view of the positive displacement pump 201 in accordance with one embodiment of the invention is shown in FIG. 4. The pump diaphragm 250 partially defines a pumping chamber 460 that is part of a pumping volume that also includes radially spaced communication passages 461 and an annular pumping groove 462. The pumping volume, including the chamber 460, passages 461 and annular pumping groove 462, is formed in the pump housing 110. The chamber 460 is radially inside the face 311, and provides clearance for movement of the diaphragm 250 during a pumping cycle.

Figure 5:
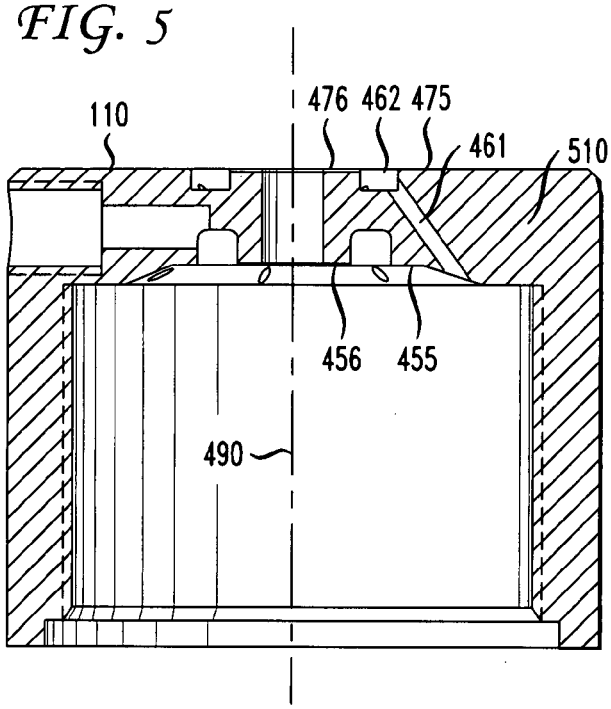
FIG. 5 is a cross sectional view of a pump housing of a gasoline unit fuel injector in accordance with the invention.
Figure 6:
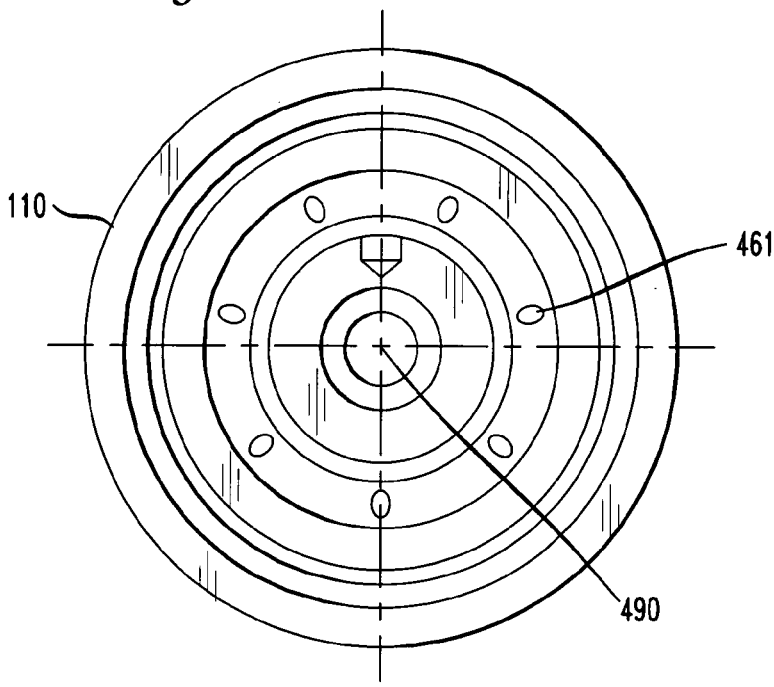
FIG. 6 is a plan view of a pump housing of a gasoline unit fuel injector in accordance with the invention.

The face 311 and chamber 460 are both formed in an inside surface of an end wall 510 of the pump housing 110 (see FIG. 5). The annular pumping groove 462 (FIG. 4) is formed on an outside surface of that end wall. The passages 461 provide fluid communication from the chamber 460 to the pumping groove 462. In the preferred embodiment, seven drilled passages are evenly spaced around a central axis 490 of the pump housing 110 (see FIG. 6). Other arrangements will be apparent to those skilled in the art.

Returning to FIG. 4, the positive displacement pump 201 further comprises the inlet 215, which includes a drilled inlet passage 415 in fluid communication with an inlet groove 416. The inlet groove 416 is immediately adjacent the pumping chamber 460. The inlet passage 415 may be a single passageway drilled from an outside periphery of the pump housing 110 and communicating with the inlet groove 416. The inlet passage may alternatively be arranged to provide a fluid inlet at another location on the fuel injector.

A pair of check valves including an inlet check valve and an outlet check valve provide for fuel flow into and out of the pumping volume. Each of the check valves is a "passive" valve in that no separate actuator is used to open and close the valve. Instead, the check valves operate in response to a fluid pressure differential across each valve. Each valve opens when the pressure differential across that valve exceeds a predetermined threshold pressure, and closes when that pressure differential falls below the predetermined threshold pressure.

The inlet valve controls flow from the inlet groove 416 to the pumping chamber 460. The valve includes a disk-shaped valve disk 452 that is preferable fabricated from spring steel or another high fatigue-life material. The valve disk 452 is fabricated as a flat disk having a central hole 454 and a peripheral region 453. The valve disk 452 is installed in the fuel injector abutting an inlet valve disk mounting surface 456 of the pump housing 110. A valve disk retaining pin 440 passes through the central hole 454 of the inlet valve disk 452 to center the disk in the housing 110. A retaining pin head 442 of the pin 440 is larger than the central hole 454 and, upon tensioning the pin 440, draws the disk 452 into contact with the mounting surface 456.

The periphery 453 of the inlet valve disk 452 contacts a sealing surface 455 of the pump housing 110. The sealing surface 455 is in a plane that is offset from a plane of the mounting surface 456 such that the disk 452 is deformed from a flat shape to a slightly conical shape when installed in contact with both the mounting surface 456 and the sealing surface 455, with the periphery 453 of the disk being biased against the sealing surface 455.

The inlet valve remains normally closed in a first mode, with the periphery 453 of the valve disk remaining in contact with the sealing surface 455. When a fuel pressure differential from the inlet 215 to the chamber 460 exceeds a threshold pressure differential, a pressure force on the inlet side of the inlet valve disk exceeds the spring bias maintaining the periphery 453 of the disk in contact with the sealing surface 455. That forces the periphery of the disk away from the sealing surface in a second, or open, mode. Fluid is thereby permitted to flow from the inlet 215 into the pumping chamber 460. When the pressure differential across the disk 452 falls below the threshold pressure, then the disk returns to the first mode, with the periphery 453 in contact with and biased against the sealing surface 455.

The threshold pressure at which the inlet valve opens depends on the amount of bias forcing the periphery 453 of the disk 452 against the sealing surface 455. The amount of bias, in turn, is a function of a spring constant of the disk, and the offset between the planes of the sealing surface and the mounting surface. The spring constant depends on the material, thickness and diameter of the disk.

The outlet valve functions in a manner similar to that of the inlet valve, with the outlet valve disk 472 having a periphery 473 and central hole 474, and being mounted in contact with an outlet sealing surface 475 and retaining surface 476 on the pump housing 110. The outlet valve disk is retained by a retainer nut 441 that is pressed, threaded, welded or otherwise attached to the retaining pin 440, compressing both the inlet valve disk 452 and the outlet valve disk 472 against their respective retaining surfaces 456, 476 on the pump housing 110.

When a pressure differential across the outlet valve exceeds a threshold pressure, the periphery 473 of the outlet valve disk 472 is forced away from the sealing surface 475, permitting fluid to escape from the outlet chamber 462 through the fuel injector outlet 451. The outlet valve is positioned in the body for discharging pressurized fuel to form a metered fuel spray. No downstream metering orifice is used.

It has been found that an injection pulse from a fuel injector of the present invention has a small initial droplet size and a small final droplet size. It is believed that that phenomenon is caused by several factors. The outlet valve gap is small when pressure is lowest at initial opening and final closing, ensuring small droplet size at the beginning and end of a pump cycle by creating what is essentially a very, very small annular orifice. Additionally, the threshold pressure required before flow is initiated through the outlet valve is relatively high compared to that of a standard gasoline fuel injector, in which pressure gradually increases and decreases in front of the orifice, resulting in a large initial and final droplet sizes.

A pump housing 110 of the present invention is shown in FIG. 5. The offset between the plane of the outlet disk sealing surface 475 and the plane of the outlet disk retaining surface 476 is closely controlled in a preferred embodiment of the invention. As noted, that offset controls the threshold pressure of the outlet valve. Both surfaces 475, 476 may be coined simultaneously to assure that the offset is closely maintained. Those surfaces may be coined together with the annular inlet groove 462. A similar technique may be used in maintaining the offset between the plane of the inlet valve sealing surface 455 and the inlet valve retaining surface 456.

In operation, the high force, high speed actuator 200 operates the positive displacement pump 201. Movement of the pump diaphragm 250 reduces the pump volume by reducing the volume of the chamber 460. Fuel is thereby displaced at high pressure through outlet valve 470. Fuel spray is formed by the geometry of outlet valve 470 at the outlet 451. The fuel spray is further influenced by the frequency of actuation of the actuator 200, and the mass and pressure of displaced fuel.

Relaxation of actuator 200, and therefore the diaphragm 250, increases pump volume in the chamber 460 and thereby draws fuel into pump volume through the inlet check valve 450.

The positive displacement pump 201 has no relative sliding surfaces, so lubrication is not necessary, and wear is minimized. The pump diaphragm 250, inlet check valve disk 452 and outlet check valve disk 472 are flexible members made of spring material to ensure nearly infinite fatigue durability.

The displacement per pump cycle is very small, and a single engine cycle injection is comprised of multiple pump cycles within the injector. The injection pulse therefore comprises many small mass injections. For example, the actuator 200 may have a displacement of about 30-40 microns, and may cycle at several kilohertz. A single engine cycle injection may last 0.05 seconds and include 100-300 actuator pulses. Using multiple, small displacements reduces injected mass per pump cycle and increases packet quantity of fuel. Those elements contribute to improved atomization in addition to the high injection pressure. Static flow is not set by an orifice, but is instead set by pump displacement and the number of pump cycles. That permits precise electronic adjustment of static flow through the engine controller, based on engine load and environmental demands.

In one exemplary embodiment, at low speed and/or cold engine temperatures, pump displacement can be reduced to extremely small levels and the number of cycles increased (which is possible due to longer injection window at low speed) to optimize atomization. At high speed and/or high temperatures, pump displacement can be increased and the number of pump cycles reduced due to better meet vaporization and fueling demands.

The pumping volume is effectively isolated from the fuel supply rail by the inlet check valve 450 and effectively isolated from the engine manifold by the outlet check valve 470. Because the outlet valve 470 opens directly into the manifold without an intervening orifice, there is no sac volume trapped beyond the valve. The inventors have found that the injector of the invention, with its series inlet and outlet valves, has practically no leakage, even with up to four times increased rail pressure.

The high injection pressure of the fuel injector of the invention is created by the internal positive displacement pump, and is available only during injection. Fuel rail pressure is used with the injector only for prevention of hot fuel vaporization, and not for injector flow. The fuel rail therefore does not require a regulator or rail pressure damper.

Figure 8:
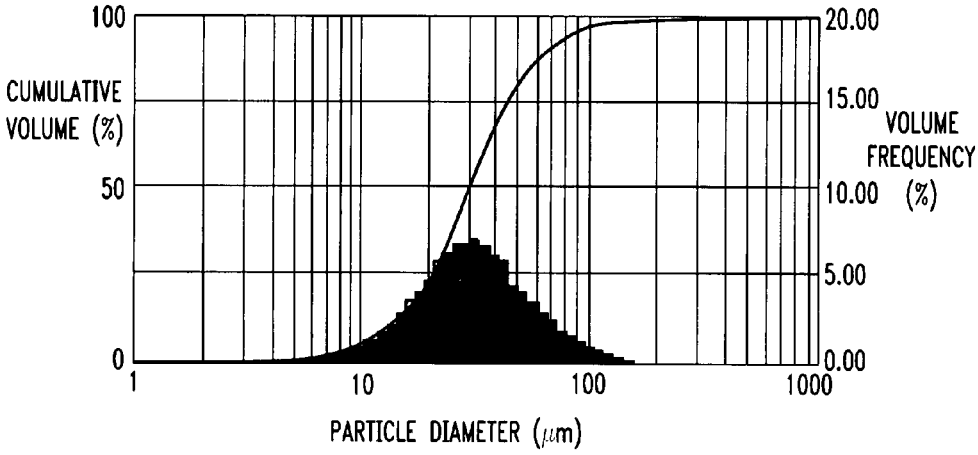
FIG. 8 is a graph showing fuel particle diameter distribution for a gasoline unit fuel injector in accordance with the invention.

Testing of the inventive fuel injector has shown that it produces nebulizer-like atomization, with particles having less than 40 microns Sauter mean diameter (SMD). The fluid breakup mechanisms at the injector outlet 451 are believed to include high pressure and high frequency. In one experiment, average SMD was 25.18 microns, with 2.16 microns standard deviation. A histogram showing the particle size distribution in that experiment is shown in FIG. 8. In comparison, a typical prior art fixed-orifice injector may produce a spray having particles with over 100 microns SMD.

The fuel injector of the present invention permits an extremely large linear flow range (LFR). It is believed that the minimum injection mass is 10 times less than an injector using a fixed orifice. In one embodiment of the invention, an engine control unit (ECU) establishes a nominal droplet size by controlling actuator stroke and frequency.

Figure 7:
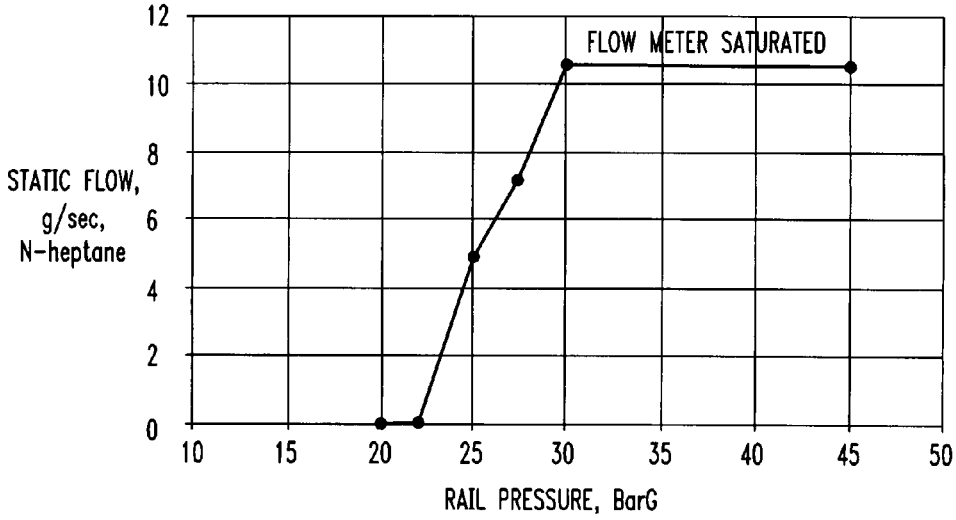
FIG. 7 is a graph showing static flow at various rail pressures for a gasoline unit fuel injector in accordance with the invention.

A plot demonstrating the static flow capability of the inventive fuel injector is shown in FIG. 7. It may be seen that a static flow of over 10 grams per second may be achieved.

Figure 9A:
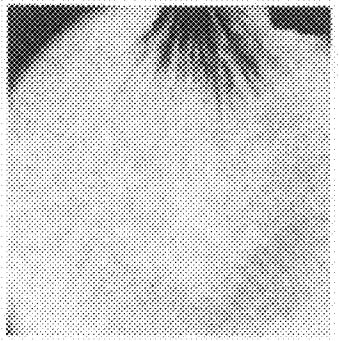
FIGS. 9*a*-9*c* are photographic representations of a fuel spray of a gasoline unit fuel injector in accordance with the invention, at various elapsed times.
Figure 9B:
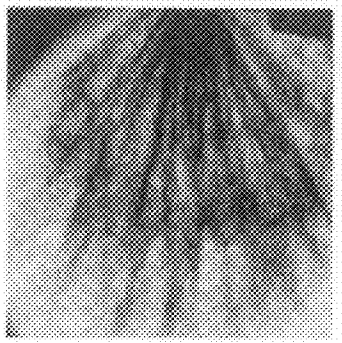
Figure 9C:
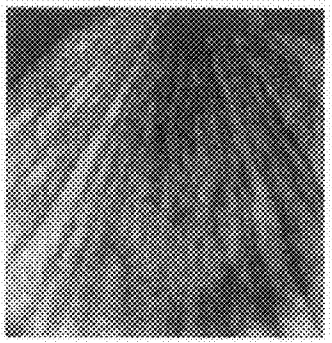
Figure 10A:
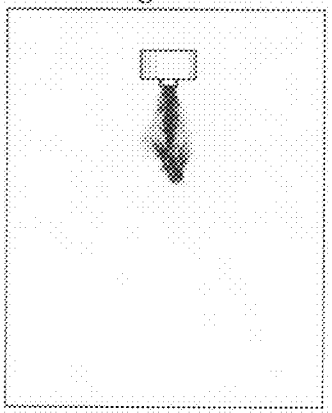
FIGS. 10*a*-10*c* are photographic representations of a fuel spray of a prior art fuel injector, at various elapsed times.
Figure 10B:
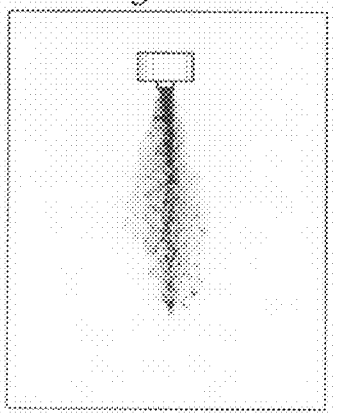
Figure 10C:
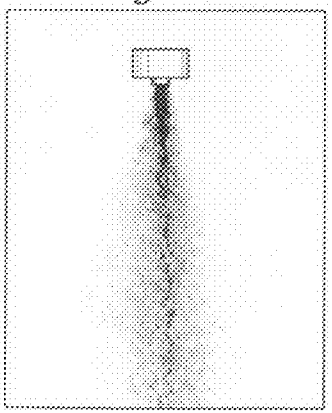

FIGS. 9*a*, 9*b* and 9*c* are results of a spray test of the inventive fuel injector. The spray is shown at three different points in time, with a total elapsed time of 2.8 milliseconds. It can be clearly seen from the illustrations that atomization is thorough, even at the beginning of the cycle shown in FIG. 9*a*. FIG. 9*c* also demonstrates a wide spray pattern angle. For comparison, FIGS. 10*a*, 10*b*, and 10*c* show results of a similar spray test using a prior art needle valve fuel injector having an 8-hole orifice disk. The three images are taken over an elapsed time of 5.9 milliseconds. It can be seen from FIG. 10*a* that atomization in the initial stages of spray development is not as complete as that of the injector of the invention (shown in FIG. 9*a*). The overall spray angle is smaller in the developed spray of FIG. 10C. Further, the elapsed time to complete spray development in the needle valve injector is over twice as long as that of the injector of the present invention.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the while the flexible pump diaphragm and valve disks are described herein as being fabricated from a spring steel material, the injector of the invention may be alternatively comprise flexible components fabricated from plastic resin. Other material substitutions are possible or will be in the future. It is to be understood that the embodiments shown and described herein are only illustrative of the principles of the present invention and that various modifications may be implemented by those skilled in the art without departing from the scope and spirit of the invention.

What is claimed is:

1. A fuel injector for forming a metered fuel spray in a fuel injection system of an internal combustion engine, the fuel injector comprising:

a body having a fuel injector inlet and a fuel injector outlet;

a positive displacement pump in the body for pumping fuel from the inlet through a pumping chamber to the outlet;

an outlet check valve located in the fuel injector outlet, the outlet check valve connected to the pumping chamber for discharging fuel from the pumping chamber, the outlet check valve comprising an outlet valve disk having a periphery and a central hole;

an annular outlet check valve sealing surface on the fuel injector body, the annular outlet check valve sealing surface facing the periphery of the outlet valve disk;

an inlet check valve located in the fuel injector inlet, the inlet check valve connected to the positive displacement pump for admitting fuel to the pump, the inlet check valve comprising an inlet valve disk having a periphery and a central hole;

an annular inlet check valve sealing surface on the fuel injector body, the annular inlet check valve sealing surface facing the periphery of the inlet valve disk; and a check valve disk retainer pin disposed in the central holes of the inlet and outlet check valve disks, the retainer pin exerting a force on the inlet valve disk biasing the periphery of the inlet valve disk against the inlet check valve sealing surface, the retainer pin further exerting a force on the outlet valve disk biasing the periphery of the outlet valve disk against the outlet check valve sealing surface.

2. The fuel injector of claim 1, wherein the outlet check valve is positioned in the body for discharging pressurized fuel to form the metered fuel spray.

3. The fuel injector of claim 1, wherein the outlet check valve has a first mode wherein the periphery contacts the annular outlet valve sealing surface to prevent flow through the outlet check valve, and a second mode wherein at least a portion of the periphery is displaced from the annular outlet valve sealing surface to discharge pressurized fuel from the pumping chamber.

4. The fuel injector of claim 1, wherein the outlet valve disk is deformable to displace at least a portion of the periphery of the disk away from the annular outlet valve sealing surface when a fuel pressure gradient across the outlet check valve exceeds a predetermined value.

5. The fuel injector of claim 1, wherein the positive displacement pump comprises:

a pump diaphragm that flexes to change a volume of the pumping chamber.

6. The fuel injector of claim 1, wherein the positive displacement pump comprises a piezoelectric actuator.

7. The fuel injector of claim 1, wherein the positive displacement pump comprises a magnetostrictive actuator.

8. The fuel injector of claim 1, wherein the inlet check valve has a first mode wherein the periphery contacts the annular inlet valve sealing surface to prevent flow through the inlet check valve, and a second mode wherein at least a portion of the periphery is displaced from the annular inlet valve sealing surface to admit fuel to the pumping chamber.

* * * * *